US005944614A

United States Patent [19]

Yoon

[11] Patent Number: 5,944,614

[45] Date of Patent: Aug. 31, 1999

[54] GOLF CLUB HEAD

[76] Inventor: Jong M. Yoon, 715 S. Oxford Ave., #310, Los Angeles, Calif. 90005

[21] Appl. No.: 09/082,410

[22] Filed: May 20, 1998

[51] Int. Cl.[6] ..... A63B 53/04; A63B 69/36

[52] U.S. Cl. ..... 473/224; 473/327

[58] Field of Search ..... 473/223, 224, 473/228, 324, 327, 345, 505, 506, 507, 510, 511, 512, 514, 515, 330, 331

[56] References Cited

U.S. PATENT DOCUMENTS

| | | |
|---|---|---|
| D. 285,231 | 8/1986 | Solomon . |
| D. 353,176 | 12/1994 | Poggi . |
| 3,794,328 | 2/1974 | Gordon . |
| 3,819,180 | 6/1974 | Murphy . |
| 4,213,613 | 7/1980 | Nygren . |
| 4,809,982 | 3/1989 | Kobayashi . |
| 5,054,784 | 10/1991 | Collins . |
| 5,158,296 | 10/1992 | Lee . |
| 5,221,086 | 6/1993 | Antonious . |
| 5,271,622 | 12/1993 | Rogerson . |
| 5,301,941 | 4/1994 | Allen . |
| 5,524,890 | 6/1996 | Kim et al. . |
| 5,529,303 | 6/1996 | Chen . |
| 5,681,227 | 10/1997 | Sayrizi . |

*Primary Examiner*—Sebastiano Passaniti
*Attorney, Agent, or Firm*—John K. Park; Law Offices of John K. Park & Assoc.

[57] ABSTRACT

The present invention has three essential parts. The first part is a head body comprised of a loop frame and a hosel. The second part is a plurality of horizontal plates set within the loop frame. The third part is a plurality of vertical supports affixed among the horizontal plates so that no part of the vertical supports form the part of the golf ball hitting surface referred to as the club front face.

20 Claims, 4 Drawing Sheets

GOLF CLUB HEAD

BACKGROUND

This present invention relates to an improved golf club head. More particularly, this invention relates to an improved golf club head which will reduce air drag significantly without imparting side rotation on the golf ball.

It is a common understanding that if the golf club head speed could be increased without affecting the control of the ball, then the golf game would improve. This is true due to the additional distance the golf ball would travel as the kinetic energy imparted on the ball would be greater. Therefore, there have been a numerous attempts in developing a golf club head design which will accommodate the greater club head speed.

One attempt that has been favored by many golf club head designers is the use of various sized holes through the golf club head so that the air may be flowed through the golf club head. Some of the problems of these designs are (1) the holes to the face ratio is too small so the reduced air friction is negligible, (2) the air flow through the holes create an air path which affect the swing path of the golf club head, and (3) the weight of the head is needlessly reduced by one or more cavities created by the holes.

Another attempt has been the use of many flat plates, both horizontal and vertical, to form the hitting surface. However, with this configuration, although the much of the air friction is reduced, the vertical plates (which were to provide the stiffness to the horizontal plates) imparted undesired spin on the golf ball as the surfaces of the vertical plates were touching and impacting the ball. This undesired spin on the golf ball made the user to lose some valuable control of the golf ball.

For the foregoing reasons, there is a need for a new and improved golf club head that will reduce air drag significantly without imparting side rotations on the golf ball.

SUMMARY

This present invention relates to an improved golf club head. This invention provides an improved golf club head that reduces air drag significantly without imparting side rotations on to the golf ball.

The reduced air drag of the golf club head directly means increased golf club head speed. The increased golf club head speed then directly means greater kinetic energy being transferred on to the golf ball. The greater energy transferred onto the golf ball directly means a longer flight of the golf ball. The inventor, through experiments with the present invention, has experienced a dramatic increased speed of the golf club head during a swing such that the distance of the golf ball's flight has improved as much as twenty to thirty percent, and more.

Moreover, because the flow of the air through the golf club head is designed so that the air will flow though the golf club head without exerting any vertical or horizontal forces on the club head, the travel of the golf club head has also been more accurate between swings to give better consistency. Therefore, increased golf club head speed and the more accurate flight trajectory have given the present invention significant improvement compared to previous designs.

The present invention has three essential parts. The first part is a head body comprised of a loop frame and a hosel. The second part is a plurality of horizontal plates set within the loop frame. The third part is a plurality of vertical supports affixed among the horizontal plates so that no part of the vertical supports form the part of the golf ball hitting surface, hereafter referred to as the club front face. A several alternate versions of the present invention are illustrated herein.

Another improvement to the invention may be obtained by attaching one or more whistles on or near a vertical support. The whistles provide different pitched sounds when the golf club head is swung at different angles, so the user may correct his or her swing.

DESCRIPTIONS OF FIGURES

DETAILED DESCRIPTION

This present invention relates to an improved golf club head 20. More specifically, this invention provides an improved golf club head 20 that reduces air drag significantly without imparting side rotations on to the golf ball.

Figure 1:
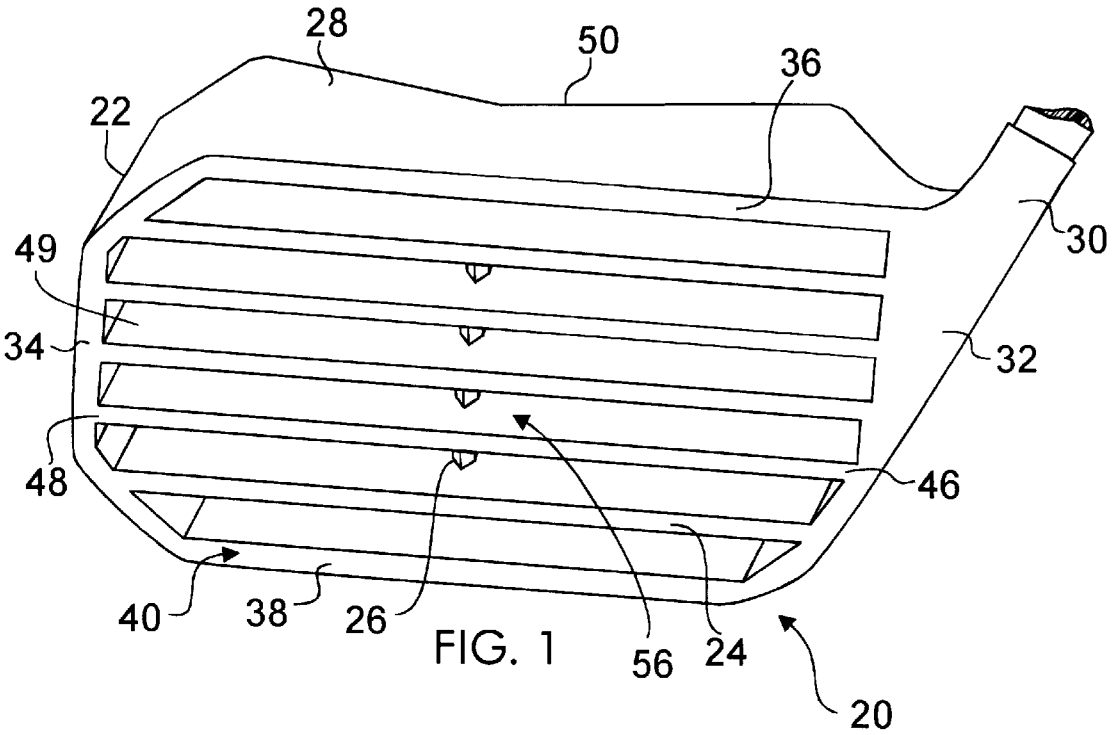
FIG. 1 is an isometric view of the present invention.
Figure 2:
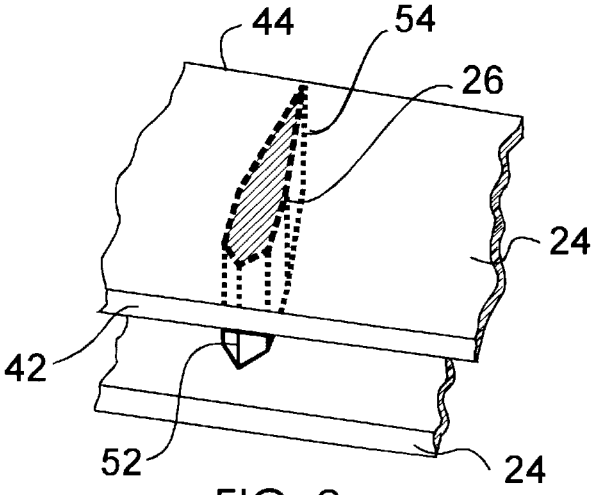
FIG. 2 is an expanded view of a vertical support between two horizontal plates.

Referring to the drawings, FIG. 1 and FIG. 2 show the improved golf club head 20 that reduces air drag significantly without imparting side rotation on to the golf ball. The golf club head 20 is generally comprised of a head body 22, a plurality of horizontal plates 24, and a plurality of vertical supports 26.

The head body 22 comprises of a loop frame 28 and a hosel 30. The loop frame 28 comprises of a heel 32, a toe 34, an upper surface 36 and a lower surface 38, so that the hosel 30 is attached to the heel 32, the heel 32 is attached to the upper surface 36 and the lower surface 38, and the toe 34 is attached to the upper surface 36 and the lower surface 38.

Within the loop frame 28, there are more than one horizontal plates 24 affixed to the toe 34 and the heel 32 to form a club front face 40 along with the loop frame 28. Each of the horizontal plates 24 has a front end 42, a rear end 44, a heel end 46 and a toe end 48. As the designation of these names indicates, the heel end 46 of the horizontal plate is attached to the heel 32 and the toe end 48 of the horizontal plate is attached to the toe 34.

The plurality of horizontal plates 24 and the loop frame 28 form a plurality of horizontal cavities 49 in the head body 22 so that air may easily pass through the cavities 49. The loop frame 28 and the front ends 42 of the horizontal plates 24 form a club front face 40. Additionally, the rear ends 44 of the horizontal plates 24 form a club rear face 50. The club front face 40 is the golf ball hitting area.

FIG. 1 and FIG. 2 further illustrate the use of the vertical supports 26 to add rigidity to the horizontal plates 24. A detail of one of the vertical supports 26 is better illustrated in FIG. 2.

In FIG. 2, a vertical support 26 is shown to have a vertical support front 52 and a vertical support rear 54. Two or more vertical supports 26 affixed among the horizontal plates 24 form a vertical support system 56. In the vertical support system 56, each vertical support 26 is affixed between two horizontal plates 24 to provide stiffness to the affixed horizontal plates 24.

As illustrated in FIG. 2, one of the most significant aspects of this invention is that each of the vertical support front 52 is set back from the club front face 40 so that each of the vertical support front 52 does not form a part of the club front face 40. Because none of the vertical support front 52 touches a golf ball upon an impact during a golf swing, no side rotation that causes the slicing or hooking is imparted onto the golf ball. Therefore, the ball can fly straighter than other golf club head designs with holes or open cavities 49. The straighter the golf ball flight path would mean the better ball control.

Also illustrated in FIG. 1 and FIG. 2 is an air foil design used by one or more of the vertical supports 26. When the vertical supports 26 are shaped like conventional air foils, the air friction created by the vertical supports 26 are reduced compared to various other possible shapes. As the air friction is reduced, the club head speed would increase correspondingly, giving additional flight distance to the ball after the impact. Moreover, because air foils in the symmetrical design as shown in FIG. 2 tend to guide the air flow straight back, the golf club head 20 would travel on a straight path during the golf swing. The straighter the path of the golf club head 20 is during the swing, the better control of the ball can be achieved. Therefore, the use of the air foil design for all of the vertical supports 26 is preferred. Of course, a variations of the vertical support 26 designs are available, such as the vertical supports 26 shaped like long rectangle plates or even simple cylinders of various oval shapes.

FIG. 2 also illustrates the use of a vertical support 26 wherein the vertical support rear 54 is extended to the club rear face 50 to form a part of the club rear face 50 along with the rear ends 44 of the horizontal plates 24. An advantage of this version is that the vertical supports 26 are used to stiffen nearly the entire width of the horizontal plates 24, providing the most rigidity of the club front face 40 during the impact of the ball. The use of the vertical supports 26 having the vertical support rears 54 extended to the club rear face 50 is preferred.

Figure 3:
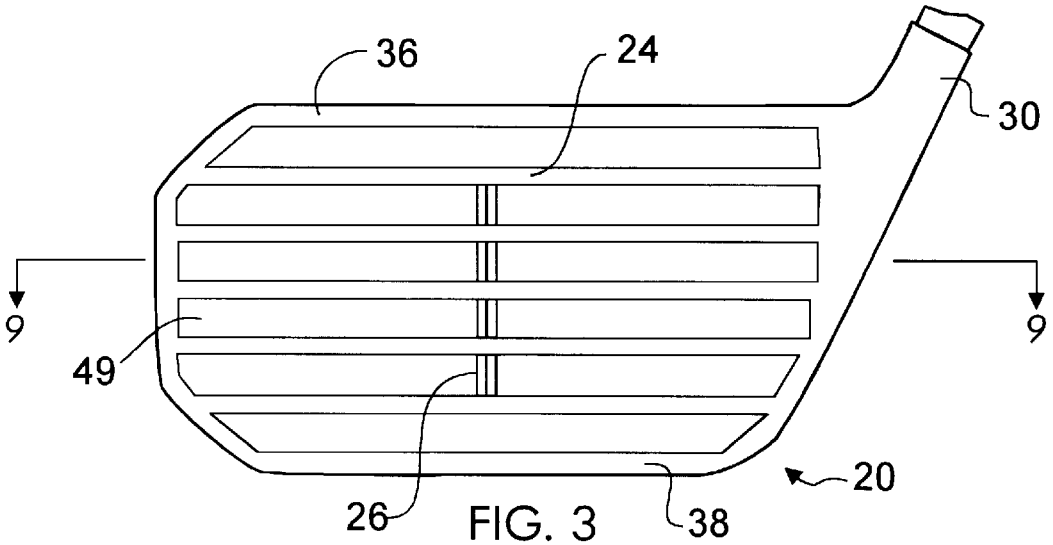
FIG. 3 is a front view of one version of the present invention.

FIG. 3 illustrates the front view of the version of this invention as illustrated in FIG. 1 and FIG. 2. One advantage of this version is the cost savings as there are fewest parts among the versions represented in this application.

Figure 4:
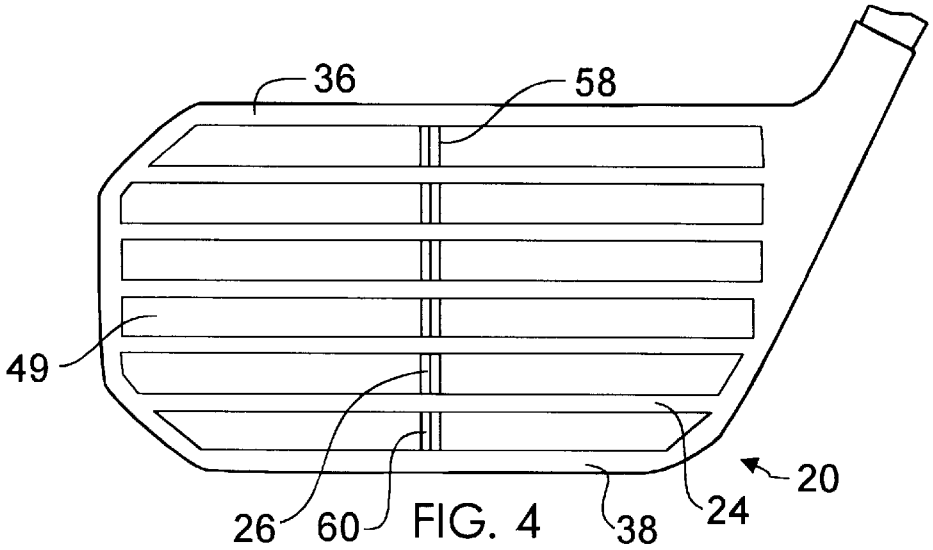
FIG. 4 is a front view of another version of the present invention.

FIG. 4 illustrates the use of an upper surface support 58 and a lower surface support 60. Also in this figure, the upper surface support 58, the lower surface support 60, and the vertical supports 26 are all in a vertical line at about the middle portion of the club front face 40.

Figure 5:
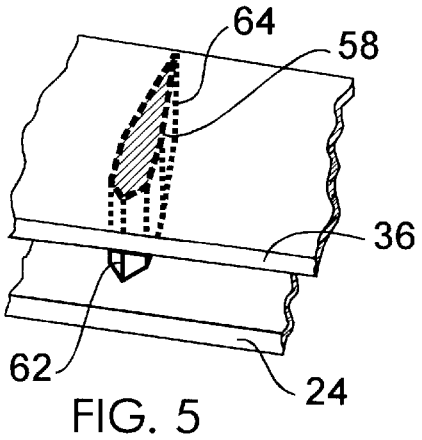
FIG. 5 is an expanded view of an upper surface support between the upper surface and the adjacent horizontal plate.
Figure 6:
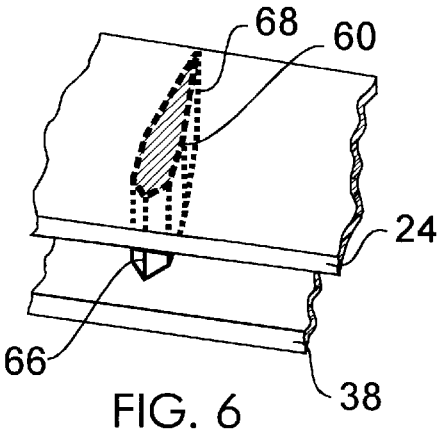
FIG. 6 is an expanded view of a lower surface support between the lower surface and the adjacent horizontal plate.

FIG. 5 and FIG. 6 illustrate the upper surface support 58 having an upper surface support front 62 and an upper surface support rear 64, and the lower surface support 60 having a lower surface support front 66 and a lower surface support rear 68. Unlike the vertical supports 26, because the upper surface support front 62 and the lower surface support front 66 generally do not touch the golf ball during the impact (as the upper surface support front 62 and the lower surface support front 66 are located outside what would be considered as the "sweet spot" wherein the sweet spot is the ideal location where the golf ball impact should be made on the club front face 40 to give the best ball control), the upper surface support front 62 and the lower surface support front 66 may or may not form a part of the club front face 40. A version which the upper surface support front 62 and the lower surface support front 66 do not form a part of the club font face is preferred.

Similar to the vertical support 26 design, a preferred version would utilize the air foil design for both the upper surface support 58 and the lower surface support 60. Moreover, the length of both the upper surface support 58 and the lower surface support 60 would extend out to the club rear face 50 to form a part of the club rear face 50 along with the rear ends 44 of the horizontal plates 24 and vertical support rears 54.

Figure 7:
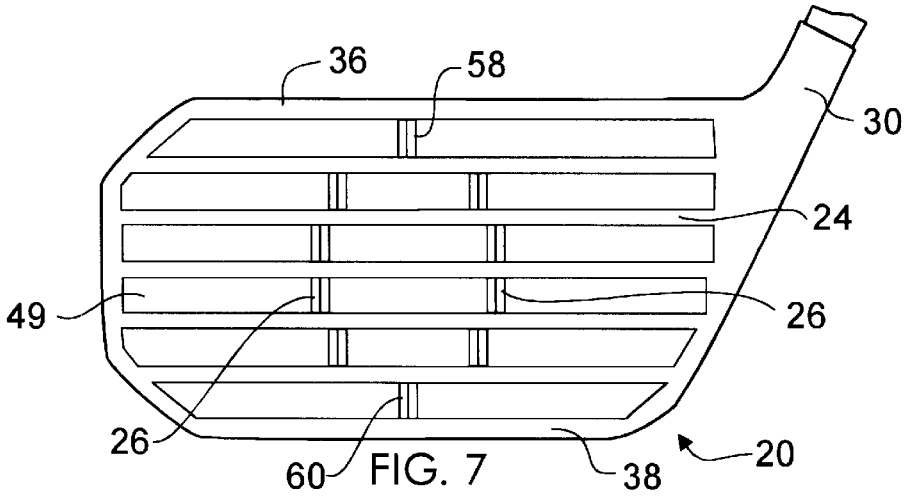
FIG. 7 is a front view of another version of the present invention.

FIG. 7 illustrates another version wherein the vertical supports 26 are scattered through out among the horizontal plates 24. If more than one vertical support 26 is used between two adjacent horizontal plates 24, then it is preferred that the spacing between two vertical supports 26 on a given two horizontal plates 24 is between about 15 millimeters and about 25 millimeters or more.

The preferred thickness of each of the horizontal plates 24 is about 2 to 4 millimeters. The general spacing between two horizontal plates 24 should be between about 2 millimeters and about 10 millimeters. Preferably, however, the golf club head 20 in a form of iron should have the horizontal spacing of between about 4 millimeters and about 6 millimeters, and the golf club head 20 in a form of wood should have the horizontal spacing of between about 6 millimeters and about 7 millimeters.

Figure 8:
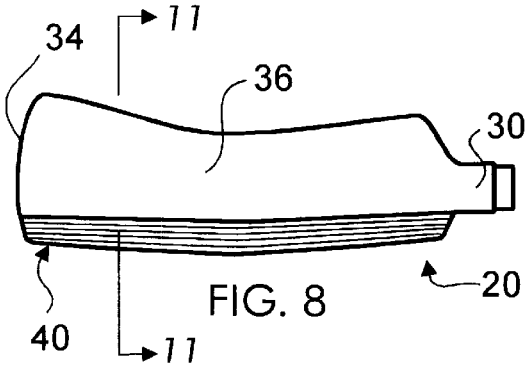
FIG. 8 is a top plan view of one version of the present invention.
Figure 9:
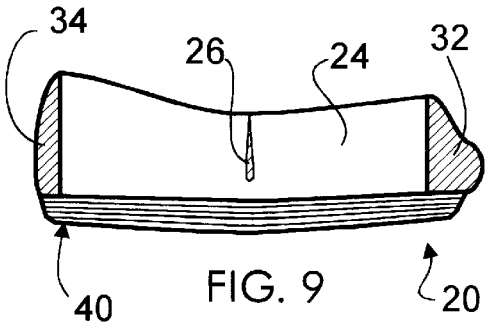
FIG. 9 is a cross-sectional view taken on line 9—9 of FIG. 4.

FIG. 8 shows a top plan view of one version of the present invention. The golf club head 20 is in a form of iron. FIG. 9 is a cross-sectional view taken on line 9—9 of FIG. 4. A cross sectional view of the vertical support 26 is shown and the air foil design of the vertical support 26 is clearly shown. Moreover, the length of the vertical support 26 extends out to the rear ends 44 of the horizontal plates 24 form a club rear face 50.

Figure 10:
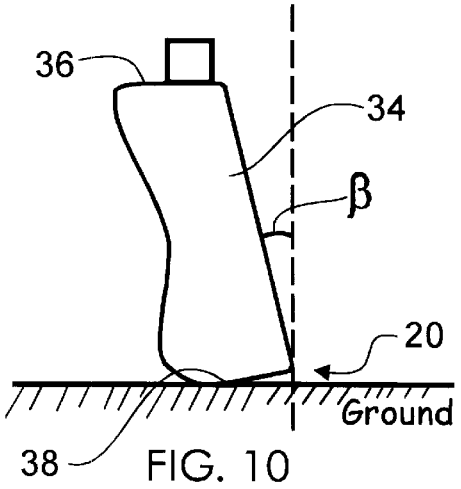
FIG. 10 is a side plan view of one version of the present invention.

FIG. 10 shows a side plan view of the version of FIG. 8. Also, in FIG. 11, a cross-sectional view taken on line 11—11 on FIG. 8 is shown. In this figure, one can clearly see that the horizontal plates 24 extend from the club front face 40 to the club rear face 50. Moreover, the club front face 40 is formed by the horizontal plates 24, the heel 32, the upper surface 36, the lower surface 38, and the toe 34 (toe 34 is not shown in FIG. 11, but shown in FIG. 10). Furthermore, the vertical supports 26, the upper surface support 58 and the lower surface support 60 extend from some distance back from the club front face 40 to the club rear face 50. It is preferred that the set back of the vertical supports 26, the upper surface support 58 and the lower surface support 60 from the club front face 40 to be between about 2 millimeters and 5 millimeters. Because the vertical supports 26, the upper surface support 58 and the lower surface support 60 are set back from the club front face 40, the golf ball never makes contact with the vertical supports 26, the upper surface support 58 and the lower surface support 60, and there are no side spin imparted onto the ball.

Figure 11:
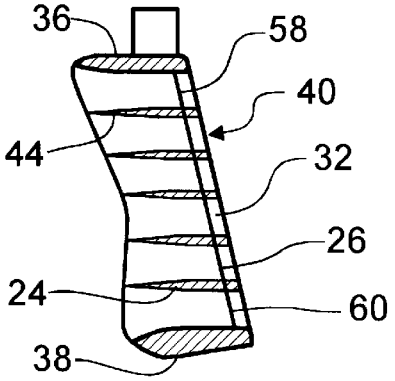
FIG. 11 is a cross-sectional view taken on line 11—11 of FIG. 8.
Figure 12:
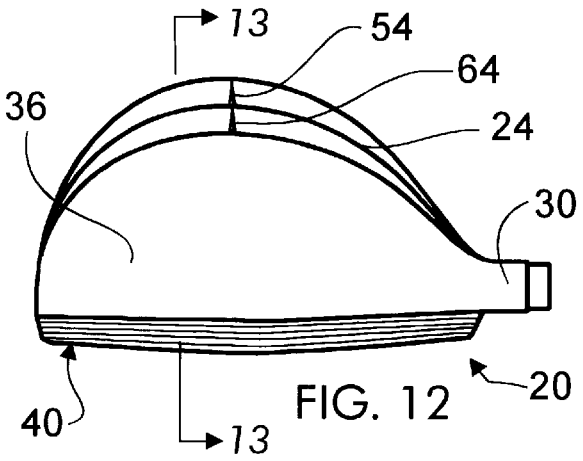
FIG. 12 is a top plan view of one version of the present invention.
Figure 13:
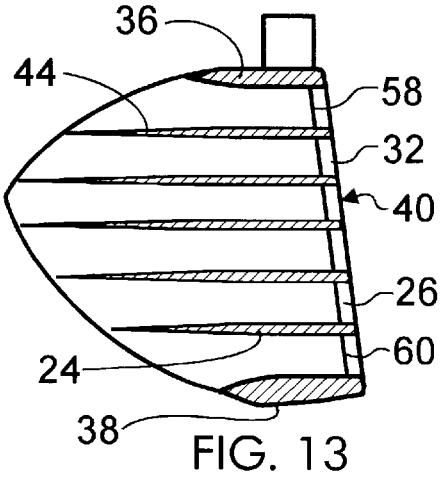
FIG. 13 is a cross-sectional view taken on line 13—13 of FIG. 12.

FIG. 12 shows a top plan view of one version of the present invention. The golf club head 20 is in a form of wood. FIG. 13 is a cross-sectional view taken on line 13—13 of FIG. 12. In this figure, similar to FIG. 11, one can clearly see that the horizontal plates 24 extend from the club front face 40 to the club rear face 50. Also, the club front face 40 is formed by the horizontal plates 24, the heel 32, the upper surface 36, the lower surface 38, and the toe 34 (toe 34 is not shown in FIG. 13). Moreover, the vertical supports 26, the upper surface support 58 and the lower surface support 60 extend from some distance back from the club front face 40 to the club rear face 50. It is preferred that the set back of the vertical supports 26, the upper surface support 58 and the lower surface support 60 from the club front face 40 to be between about 2 millimeters and 5 millimeters. Because the vertical supports 26, the upper surface support 58 and the lower surface support 60 are set back from the club front face 40, the golf ball never makes contact with the vertical supports 26, the upper surface support 58 and the lower surface support 60, and there are no side spin imparted onto the ball.

Although FIG. 11 and FIG. 13 show the preferred version, it is not necessary that all of the vertical support rears 54 or the horizontal plate rear ends 44 extend out to form the club rear face 50. These variations can be alternate designs to this invention.

FIG. 10, FIG. 11 and FIG. 13 illustrate that the angle β formed by the club front face 40 and the plane perpendicular to the ground may vary. The preferred angle dimensions are between about 3 degrees and about 70 degrees. These angles may vary according to the standard club number, such as about 8 degrees for the number 1 driver and about 60 degrees for the sand wedge.

Also FIG. 11 and FIG. 13 illustrate an improvement of the basic invention which uses the horizontal plates 24 with their rear ends 44 shaped like a tail end of an air foil. This reduction of the thickness of the rear ends 44 of the horizontal plates 24 reduces the air friction and guide the air flow to help the golf club head 20 to travel on a straight path during the golf swing.

Figure 14:
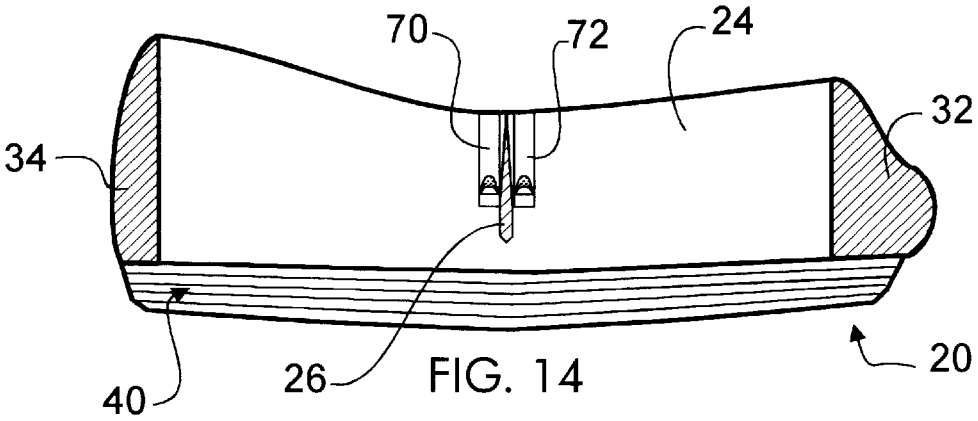
FIG. 14 is a cross-sectional view taken on line 9—9 of FIG. 4 showing a version with two whistles.

FIG. 14 is similar to FIG. 9 and it is another version of the cross-sectional view taken on line 9—9 on FIG. 4. In this cross sectional view, a first whistle 70 and a second whistle 72 are attached to each side of a vertical support 26. As alternate designs, the first whistle 70 and the second whistle 72 may be attached to the upper surface support 58 or the lower surface support 60.

The whistles 70, 72 provide different pitched sounds when the golf club head 20 is swung at different angles. That is when the golf club head 20 is turned away from the ideal position due to the over-reaching or the under-reaching of the hands or the wrists. Therefore, the user can adjust his or her swing when other than the most ideal sound is heard during his or her swing. These whistles 70, 72 can be preset so the ideal sound is sound when the line of the travel of the golf club head 20 is ideal during the swing.

The advantages of this invention are numerous. First, the reduced air drag of the golf club head 20 directly means increased golf club head 20 speed. The increased golf club speed then directly means greater kinetic energy being transferred on to the golf ball. The greater energy transferred onto the golf ball directly means a longer flight of the golf ball. The inventor, through experiments with the present invention, has experienced a dramatic increased speed of the golf club head 20 during a swing such that the distance of the golf ball's flight has improved as much as twenty to thirty percent, and more.

Moreover, because the flow of the air through the golf club head 20 is designed so that the air will flow though the golf club head 20 without exerting any vertical or horizontal forces on the club head, the travel of the golf club head 20 has also been more accurate between swings to give better consistency. Therefore, increased golf club head 20 speed and the more accurate flight trajectory have given the present invention significant improvement compared to previous designs.

Another advantage is that the golf club head 20 can be increased to a great size without being too heavy. Because this invention has a large volume of empty cavities 49, the weight of a standard golf club head can achieve the size of the golf club head 20, more specifically the size of the club front face 40, that is two to three times larger than the conventional golf club head 20. An increased golf club head 20 size would mean the increase in the area of the sweet spot that enable a better ball control.

Figure 15:
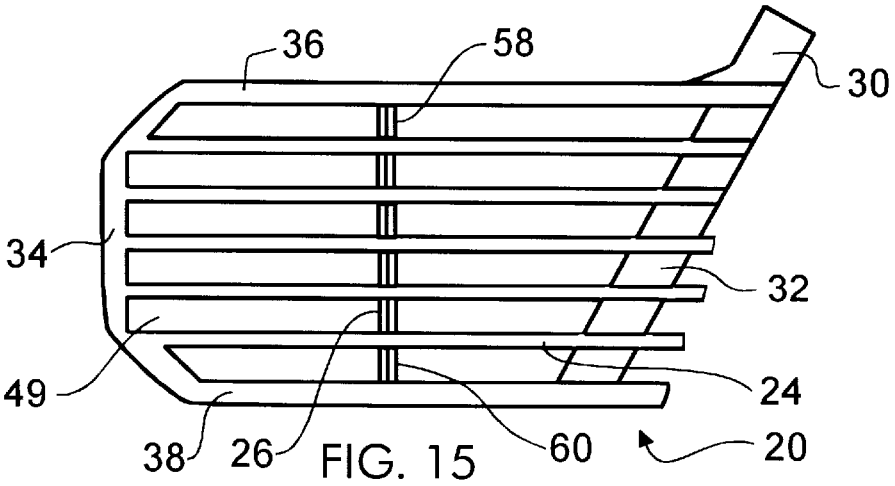
FIG. 15 is a front view of another version of the present invention.

Although the invention has been described in considerable detail with reference to certain preferred versions thereof, other versions are possible. For example, a creative design may result in an embodiment similar to the one illustrated in FIG. 15.

What I claim is:

1. A golf club head comprising:

a) a head body formed by a loop frame and a hosel, wherein the loop frame comprises of a heel, a toe, an upper surface and a lower surface, so that the hosel is attached to the heel, the heel is attached to the upper surface and the lower surface, and the toe is attached to the upper surface and the lower surface;

b) a plurality of horizontal plates wherein each horizontal plate has a front end, a rear end, a heel end and a toe end, wherein the heel end is attached to the heel and the toe end is attached to the toe, wherein the plurality of horizontal plates and the loop frame form a plurality of horizontal cavities in the head body, and wherein the loop frame and the front ends of the horizontal plates form a club front face and the loop frame and the rear ends of the horizontal plates form a club rear face; and c) a plurality of vertical supports affixed among the horizontal plates so the plurality of the vertical supports form a vertical support system, wherein each of the vertical supports has a vertical support front and a vertical support rear, wherein each vertical support is affixed between two horizontal plates to provide rigidity to the affixed horizontal plates, and wherein each of the vertical support front is set back from the club front face so that each of the vertical support front does not form a part of the club front face so that each of the vertical support front does not touch a golf ball upon an impact during a golf swing.

2. A golf club head of claim 1 wherein the head body further comprises of an upper surface support affixed between the upper surface of the loop frame and the adjacent horizontal plate, and a lower surface support affixed between the lower surface of the loop frame and the adjacent horizontal plate.

3. A golf club head of claim 2 wherein the upper surface support has an upper surface support front and an upper surface support rear, and the lower surface support has a lower surface support front and a lower surface support rear, and wherein the upper surface support front is set back from the club front face and the lower surface support front is set back from the club front face so that the upper surface support front and the lower surface support front do not form the club front face so that the upper surface support front and the lower surface support front do not touch a golf ball upon an impact during a golf swing.

4. A golf club head of claim 3 wherein each of the vertical supports forms a long rectangle plate to reduce the air friction and guide the air flow to help the golf club head to travel on a straight path during the golf swing.

5. A golf club head of claim 3 wherein each of the vertical supports forms an air foil to reduce the air friction and guide the air flow to help the golf club head to travel on a straight path during the golf swing.

6. A golf club head of claim 5 wherein each of the rear end of the horizontal plates forms a tail end of an air foil to reduce the air friction and guide the air flow to help the golf club head to travel on a straight path during the golf swing.

7. A golf club head of claim 6 wherein the spacing between two horizontal plates is between about 2 millimeters and about 10 millimeters.

8. A golf club head of claim 7 wherein the spacing between two horizontal plates is between about 4 millimeters and about 7 millimeters.

9. A golf club head of claim 8 wherein the spacing between two horizontal plates is between about 4 millimeters and about 6 millimeters, and the golf club head is in a form of iron.

10. A golf club head of claim 8 wherein the spacing between two horizontal plates is between about 6 millimeters and about 7 millimeters, and the golf club head is in a form of wood.

11. A golf club head of claim 8 where the angle formed by the club front face and the plane perpendicular to the ground as the golf club head strikes the ball during the golf swing is between about 8 degrees and about 70 degrees.

12. A golf club head of claim 8 wherein the golf club head further comprises a first whistle attached to one side of a vertical support, an upper surface support, or a lower surface support.

13. A golf club head of claim 11 wherein the golf club head further comprises a second whistle attached to one side of a vertical support, an upper surface support, or a lower surface support, so that the second whistle is on the opposite side of the first whistle.

14. A golf club head of claim 2 wherein each of the vertical support rear is extended to the club rear face to form a part of the club rear face along with the rear ends of the horizontal plates.

15. A golf club head of claim 14 wherein the upper surface support rear and the lower surface support rear are extended to the club rear face to form a part of the club rear face along with the rear ends of the horizontal plates.

16. A golf club head of claim 15 wherein the spacing between two horizontal plates is between about 4 millimeters and about 6 millimeters, and the golf club head is in a form of iron.

17. A golf club head of claim 16 wherein the spacing between two horizontal plates is between about 6 millimeters and about 7 millimeters, and the golf club head is in a form of wood.

18. A golf club head of claim 17 wherein the angle formed by the club front face and the plane perpendicular to the ground as the golf club head strikes the ball during the golf swing is between about 8 degrees and about 70 degrees.

19. A golf club head of claim 18 wherein the golf club head further comprises a first whistle attached to one side of a vertical support, an upper surface support, or a lower surface support.

20. A golf club head of claim 19 wherein the golf club head further comprises a second whistle attached to one side of a vertical support, an upper surface support, or a lower surface support, so that the second whistle is on the opposite side of the first whistle.

* * * * *